US010859238B2

(12) United States Patent
Zhu

(10) Patent No.: US 10,859,238 B2
(45) Date of Patent: Dec. 8, 2020

(54) REFLECTOR AND LIGHT SOURCE MODULE

(71) Applicant: OPPLE LIGHTING CO., LTD., Shanghai (CN)

(72) Inventor: Wenxue Zhu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 80 days.

(21) Appl. No.: 16/281,850

(22) Filed: Feb. 21, 2019

(65) Prior Publication Data

US 2019/0178469 A1 Jun. 13, 2019

Related U.S. Application Data

(63) Continuation of application No. PCT/CN2017/097207, filed on Aug. 11, 2017.

(30) Foreign Application Priority Data

Aug. 24, 2016 (CN) ..... 2016 2 0933852 U

(51) Int. Cl.
*F21V 7/00* (2006.01)
*F21V 7/22* (2018.01)
(Continued)

(52) U.S. Cl.
CPC ..... *F21V 7/22* (2013.01); *F21V 7/0025* (2013.01); *F21V 7/048* (2013.01); *F21V 7/09* (2013.01); *F21V 7/10* (2013.01); *F21Y 2115/10* (2016.08)

(58) Field of Classification Search
CPC ..... F21V 7/22; F21V 7/0025; F21V 7/048; F21V 7/09; F21V 7/10; F21Y 2115/10
(Continued)

(56) References Cited

U.S. PATENT DOCUMENTS 1,570,503 A * 1/1926 Kralicek ..... F21S 41/333 362/349
3,433,941 A * 3/1969 Hall ..... F21V 17/00 362/297

(Continued)

FOREIGN PATENT DOCUMENTS

CN 101078495 A 11/2007
CN 101405539 A 4/2009

(Continued)

OTHER PUBLICATIONS

International Search Report (including English translation) and Written Opinion issued in PCT/CN2017/097207, dated Oct. 27, 2017, 10 pages.

*Primary Examiner* — Ali Alavi
(74) *Attorney, Agent, or Firm* — Arch & Lake LLP

(57) ABSTRACT

The present disclosure provides a reflector and a light source module. The reflector is provided with a first end surface and a second end surface opposite to each other; an inner surface of the reflector has a plurality of microstructures, an outer surface of at least one of the plurality of microstructures includes a first surface and a second surface, the second surface is a curved surface, the first surface has a starting edge and an ending edge opposite to the starting edge, the ending edge is connected with the second surface, at least one of the plurality of microstructures is located on a same side of a vertical plane that intersects the starting edge and is perpendicular to the first end surface. The reflector and the light source module can change the uniformity and the beam angle of the light, meanwhile, can ensure the achievability of the processing and manufacturing.

20 Claims, 6 Drawing Sheets

(51) Int. Cl.

| | |
|---|---|
| ***F21V 7/04*** | (2006.01) |
| ***F21V 7/09*** | (2006.01) |
| ***F21V 7/10*** | (2006.01) |
| *F21Y 115/10* | (2016.01) |

(58) Field of Classification Search
USPC ..... 362/497, 346
See application file for complete search history.

(56) References Cited

U.S. PATENT DOCUMENTS

| | | | | | |
|---|---|---|---|---|---|
| 4,021,659 | A | | 5/1977 | Wiley | |
| 4,799,136 | A | * | 1/1989 | Molnar | F21V 7/04 362/300 |
| 4,969,074 | A | * | 11/1990 | Davis | F21S 8/088 362/329 |
| 5,144,190 | A | * | 9/1992 | Thomas | F21V 19/0005 313/113 |
| 6,053,623 | A | * | 4/2000 | Jones | F21V 7/28 362/310 |
| 2012/0182741 | A1 | * | 7/2012 | Yurich | F21V 7/0008 362/304 |
| 2013/0135875 | A1 | * | 5/2013 | Schutte | F21V 7/10 362/297 |
| 2014/0169002 | A1 | * | 6/2014 | Mocking | F21V 7/24 362/346 |
| 2014/0247599 | A1 | * | 9/2014 | Yurich | F21K 9/60 362/304 |

FOREIGN PATENT DOCUMENTS

| | | | |
|---|---|---|---|
| CN | 202091931 | U | 12/2011 |
| CN | 205938998 | U | 2/2017 |

* cited by examiner

REFLECTOR AND LIGHT SOURCE MODULE

CROSS-REFERENCE TO RELATED APPLICATIONS

This application is based upon and claims the priority of PCT patent application No. PCT/CN2017/097207 filed on Aug. 11, 2017 which claims the priority of Chinese Patent Application No. 201620933852.0 filed on Aug. 24, 2016, the entire contents of which are hereby incorporated by reference herein.

TECHNICAL FIELD

The present disclosure relates to a lighting technology field, and in particular, to a reflector and a light source module applied to a lighting device.

BACKGROUND

There are many light distribution schemes for a reflector of a lighting device. There are three basic requirements for light exit quality of the reflector, such as the requirements for the angle of the light, the uniformity of the light intensity and the uniformity of chromaticity of the light.

Currently, in order to meet the above requirements for the reflector, an inner surface of the reflector is mainly processed by the following treatments: a mirror treatment, a frost treatment, and a surface microstructure treatment. The inner surface of the reflector can accurately control the angle of the light and ensure the uniformity of the light of the lighting device after the surface microstructure treatment. Therefore, the microstructure is widely applied to the inner surface of the reflector of various lighting devices.

Generally, the reflector having a microstructure on the inner surface also has a first end surface and a second end surface parallel to each other, and the first end surface and the second end surface are both parallel to a horizontal plane. However, the reflector has a large design obstacle, as illustrated in FIG. 1, upon an angle between the inner surface of the reflector manufactured by a mode and the horizontal plane being required to be larger, and the microstructure 20 on the inner surface being a conventional microstructure having an arc surface, both sides of a vertical plane 10 intersecting a starting edge of the microstructure 20 and perpendicular to the first end surface have microstructures. Due to a configuration of the surface of the microstructure 20, demoulding cannot be achieved, that is, the processing and manufacturing of the reflector cannot be achieved. In summary, upon processing the reflector of the lighting device, the microstructure on the inner surface of the conventional reflector will cause a problem that the demoulding cannot be achieved due to the limitation of a draft angle in a case that an angle between a bus of the reflector and the horizontal plane.

SUMMARY

In order to solve problems in the prior art, an object of the present disclosure is to provide a reflector and a light source module which can be manufactured and have a good light distribution effect.

In order to achieve the above and other related objects, the present disclosure provides the following technical solutions.

A reflector, comprising a first end surface and a second end surface opposite to each other, an inner surface of the reflector having a plurality of microstructures. An outer surface of at least one of the plurality of microstructures includes a first surface and a second surface, the second surface is a curved surface, the first surface has a starting edge and an ending edge opposite to the starting edge, the ending edge is connected with the second surface, at least one of the plurality of microstructures is located on a same side of a vertical plane that intersects the starting edge and is perpendicular to the first end surface.

In order to achieve the above object, the present disclosure further provides a light source module, including a light source and the reflector as mentioned above. The light source is close to the first end surface of the reflector, and a size of the first end surface is greater than a size of the light source.

BRIEF DESCRIPTION OF THE DRAWINGS

In order to clearly illustrate the technical solutions of the embodiments of the disclosure or the prior art, the drawings of the embodiments of the disclosure or the prior art will be briefly described in the following; it is obvious that the described drawings are only related to some embodiments of the disclosure, for those skilled in the art, other drawings can be obtained according to these drawings without paying creative labor.

DETAILED DESCRIPTION

In order to make objects, technical details and advantages of the embodiments of the disclosure apparent, the technical solutions of the disclosure will be described in a clearly and fully understandable way in connection with the embodiments of the disclosure and the related drawings. Apparently, the described embodiments are just a part but not all of the embodiments of the disclosure. Based on the embodiments of the disclosure, those skilled in the art can obtain other embodiment(s), without any inventive work, which should be within the scope of the disclosure.

Please refer to the drawings. It should understood that the structures, proportions, sizes, and the like of the drawings are only used to match the content disclosed in the specification, used for understanding and reading by those skilled in the art, and not intended to limit the conditions that can be implemented by the present disclosure, therefore they have no technical significance. The modification, the change of the proportional relationship or the adjustment of the size of any structure should still fall within the scope of the technical content disclosed by the disclosure without affecting the effects and achievable objects of the disclosure. In the meantime, the terms "on", "under", "left", "right", "intermediate", "one" and the like used in the present specification are only for convenience of the description, and are not intended to limit the scope of the disclosure, the change or adjustment of the relative relationship is also considered as the scope of implementation of the disclosure under the technical content without substantial change.

Figure 1:
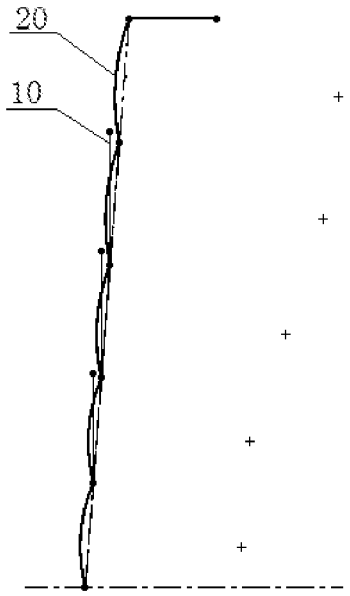
FIG. 1 is a cross-sectional view of a conventional microstructure on an inner surface of a reflector.
Figure 2:
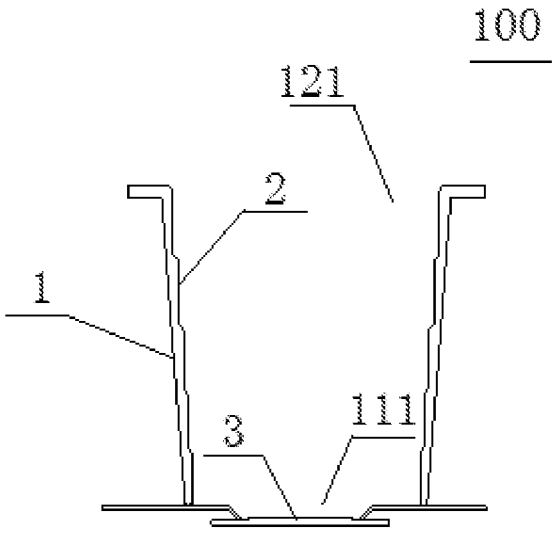
FIG. 2 is a cross-sectional view of a light source module in a first embodiment of the disclosure.

Referring to FIG. 2, a first embodiment of the disclosure provides a light source module 100 applied to a lighting device (not illustrated). The light source module 100 includes a reflector 1 and a light source 3 corresponding to the reflector 1. An inner surface of the reflector 1 is provided with a plurality of microstructures 2 arranged uniformly. Certainly, according to actual needs, the inner surface of the reflector 1 can also dispose a plurality of microstructures arranged non-uniformly. In the first embodiment, the lighting device applying the light source module 100 can be a downlight or a spotlight.

Figure 4:
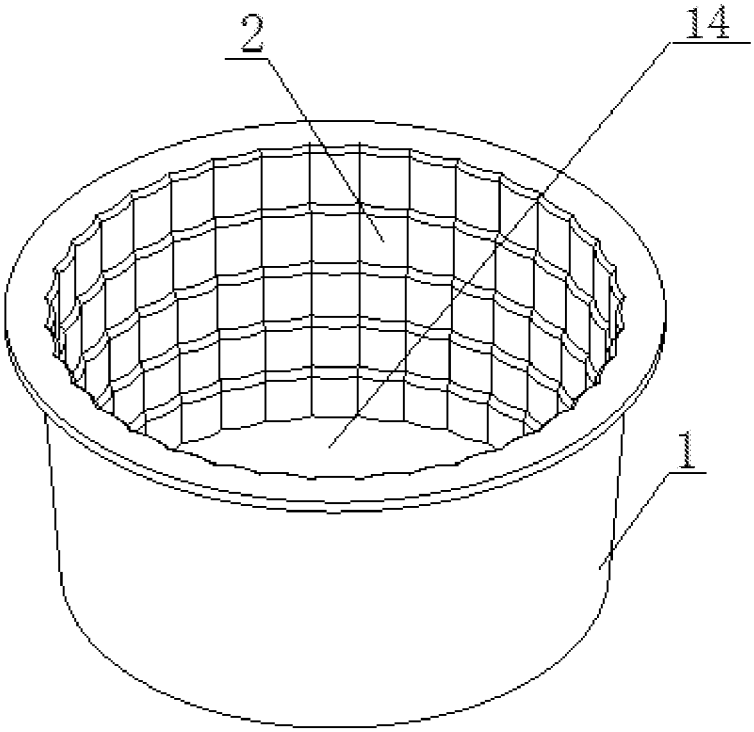
FIG. 4 is a perspective view of a reflector of the disclosure.
Figure 5:
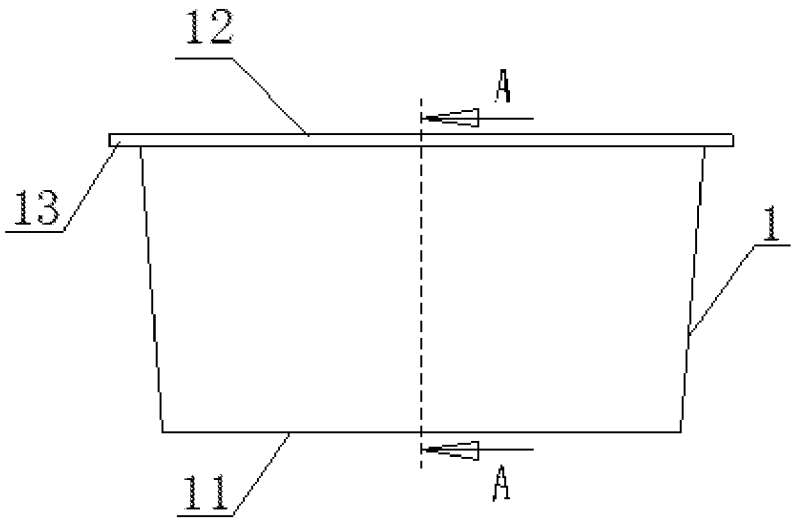
FIG. 5 is a front view of a reflector of the disclosure.

Referring to FIG. 2, FIG. 4 and FIG. 5, the reflector 1 is substantially of trumpet shape and provided with a first end surface 11 and a second end surface 12 parallel to the first end surface 12. The first end surface 11 is closed to the light source 3 and provided with a first opening 111, the first opening 111 is a light incidence opening, so that light emitted by the light source 3 enters into the reflector 1. Specifically, the first opening 111 has a shape of circular, the size thereof is greater than that of the light source 3. The second end surface 12 is provided with a second opening 121, the second opening 121 is a light exit opening, so that light reflected by the surface of the microstructure 2 and light directly emitted from the light source 3 pass through the light exit opening and exit outside the lighting device. Here, the size of the first opening is less than that of the second opening.

The light source 3 can be a light source such as an LED light source or a TL light source, which is not described in detail herein.

In the present embodiment, upon light emitted by the light source 3 entering inside of the reflector 1 through the first opening 111 and reaching the microstructure 2 on the inner surface of the reflector 1, because of the presence of the microstructure 2, the emitted light becomes more uniform, and a beam angle of the light is changed to meet requirements of the lighting device for the light uniformity and beam angle.

Figure 3:
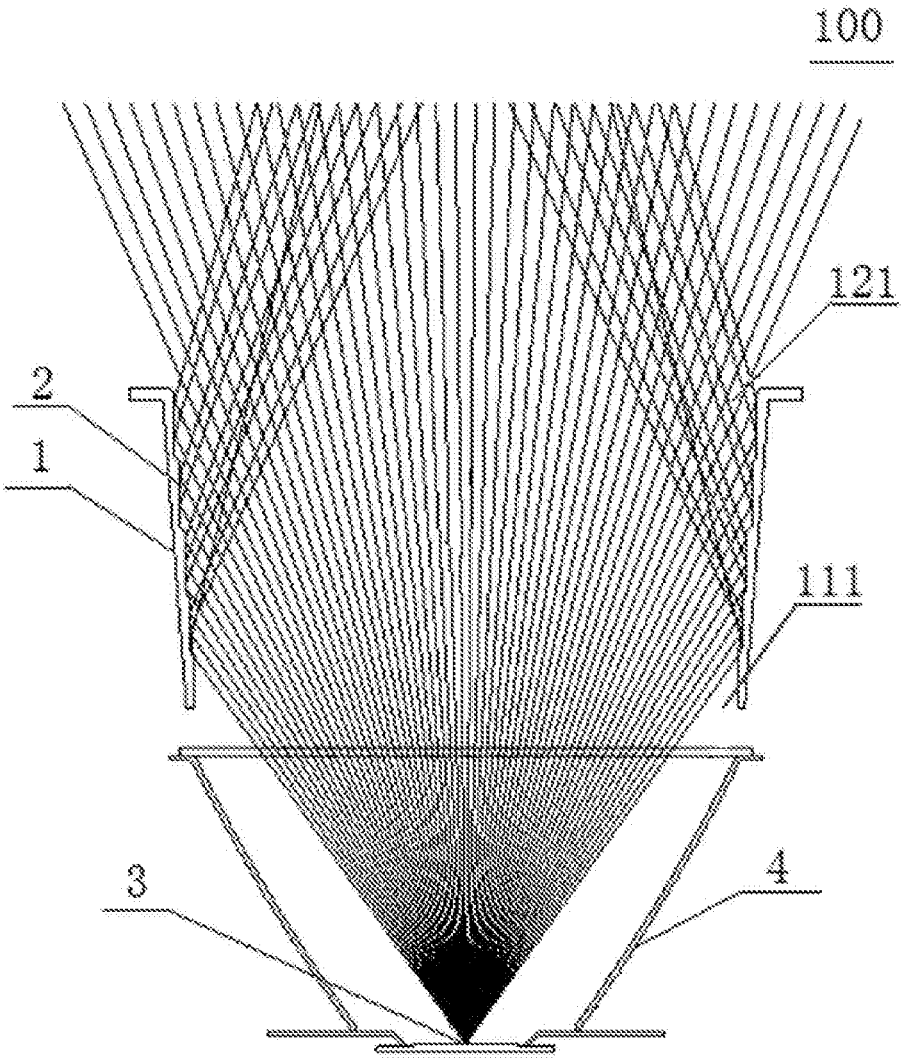
FIG. 3 is a cross-sectional view and an optical path view of a light source module in a second embodiment of the disclosure.

Referring to FIG. 3, a second embodiment of the present disclosure provides a light source module 100 applied to a lighting device (not illustrated). FIG. 3 further illustrates an optical path view of light emitted by a light source 3 in the light source module 100. In the present embodiment, the light source module 100 includes the light source 3 and a reflector 4 and a reflector 1 which are matched with the light source 3. The reflector 4 is a primary reflector, and the reflector 1 is a secondary reflector. It should be noted that, in the present disclosure, the reflector 1 in the light source module 100 in the second embodiment has the same structure as the reflector 1 in the light source module 100 in the first embodiment. Specifically, the primary reflector is close to the light source 3, and an inner surface thereof is smooth. An inner surface of the secondary reflector has microstructures 2. A difference between the light source module 100 in the second embodiment of the disclosure and the light source module 100 in the first embodiment of the disclosure is that the light source module 100 in the second embodiment of the disclosure further includes the reflector 4. The lighting device applying the light source module 100 of the second embodiment may be a deep-embedded spotlight or a wall washer.

Referring to FIG. 3, upon the light source 3 emitting light, the light emitted by the light source 3 first passes through the reflector 4, and the inner surface of the reflector 4 may adjust the uniformity of the light exiting therefrom and change the beam angle; and then the light adjusted by the inner surface of the reflector 4 enters into the reflector 1 through the first opening 111 of the reflector 1 and reaches the microstructure 2 at the inner surface of the reflector 1; finally, the light is adjusted by the microstructure 2, so that the light exiting from the second opening 121 becomes uniform and the beam angle is changed, thereby ensuring that the uniformity and the beam angle of the light reaching a user area meet the requirements. In the same time, compared with the light source module 100 in the first embodiment of the disclosure, the light source module 100 in the second embodiment of the disclosure has better anti-glare effect.

In one or more embodiments of the disclosure, according to the use's requirements for the uniformity and beam angle of the light emitted by the lighting device, the inner surface of the primary reflector, that is the reflector 4, may also have the microstructure 2.

A structure of the reflector 1 in the light source modules 100 provided by the first embodiment and the second embodiment is further described below.

Referring to FIG. 5, the reflector 1 has a first end surface 11 and a second end surface 12 parallel to each other, and the first end surface 11 is parallel to a horizontal plane.

The reflector 1 has a light channel 14. An inner diameter of the light channel 14 of the reflector 1 is gradually increased from the first end surface 11 to the second end surface 12, referring to FIG. 4 and FIG. 6.

As illustrated in FIG. 2 to FIG. 4, the inner surface of the reflector 1 has a plurality of microstructures 2, the microstructures 2 are capable of controlling the uniformity and the beam angle of the light passing through the light channel 14.

Figure 6:
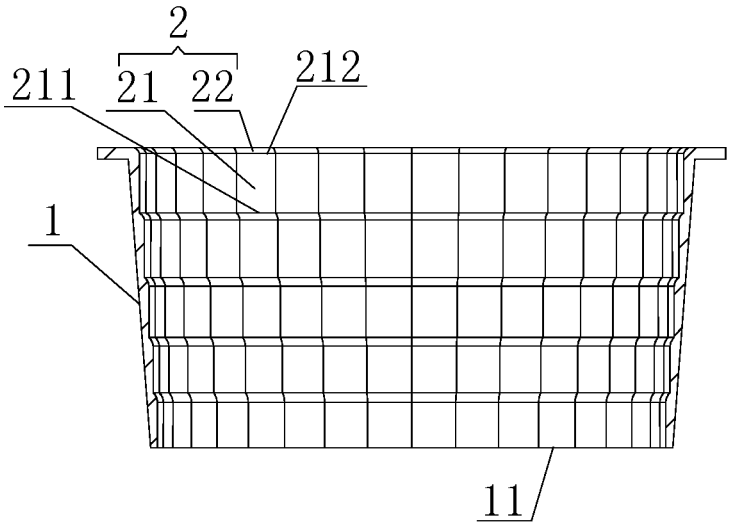
FIG. 6 is a cross-sectional view in A-A line of FIG. 5.
Figure 7:
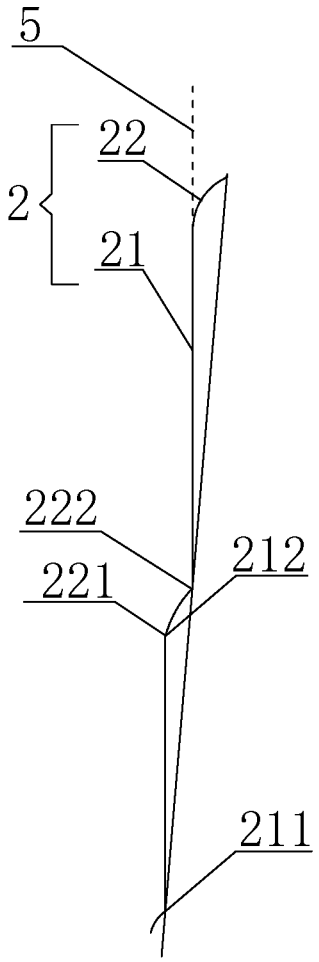
FIG. 7 is a cross-sectional view of microstructures on an inner surface of a reflector of the disclosure according to a second aspect.
Figure 8:
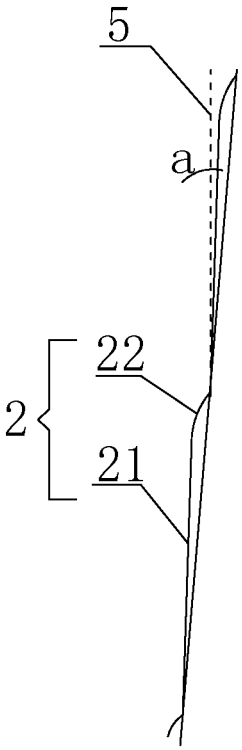
FIG. 8 is a cross-sectional view of microstructures on an inner surface of a reflector of the disclosure according to a second aspect.

As illustrated in FIG. 6 to FIG. 8, an outer surface of the microstructure 2 includes a first surface 21 and a second surface 22, and the second surface 22 is a curved surface. The first surface 21 has a starting edge 211 and an ending edge 212 opposite to each other. The ending edge 212 of the first surface 21 is connected with the second surface 22. Specifically, the second surface 22 has a starting edge 221 and an ending edge 222 opposite to each other, the starting edge 221 of the second surface 22 is connected with the ending edge 212 of the first surface 21, and the ending edge 222 of the second surface 22 is connected with the starting edge 211 of the first surface 21 or the second end surface 12. The microstructure 2 is located on the same side of a vertical plane 5 that intersects the starting edge 211 of the first surface 21 and is perpendicular to the first end surface 11, an angle between the first surface 21 and the vertical plane 5 is less than an angle between the second surface 22 and the vertical plane 5. The first surface 21 is perpendicular to the horizontal plane or has an acute angle with the vertical plane. Upon the first surface 21 being perpendicular to the horizontal plane, the first surface 21 coincides with the vertical plane 5.

Here, the ending edge 212 of the first surface 21 is smoothly connected with the second surface 22.

Furthermore, the number and size of the microstructures 2 are capable of influencing the final uniformity and beam angle of the light. Here, a spacing between two adjacent microstructures 2 is zero, that is the microstructures 2 are continuously arranged. The microstructures 2 completely cover the inner surface of the reflector 1.

Furthermore, a ratio of a length of the first surface 21 to a length of the second surface 22 in a vertical direction is an arbitrary value. Here, the length of the first surface 21 and the length of the second surface 22 in the vertical direction can be set according to the uniformity and the beam angle of the light emitted by the light source module 100 required by the user.

Referring to FIG. 6, the second surface 22 plays a main role in the uniformity and the beam angle of the light in the microstructure 2. The second surface 22 is formed by a curved bus moving at a certain angle in a circumferential direction. Here, the second surface 22 is an arc surface or a spherical surface.

In the prior art, the microstructure has an arc surface. Upon processing the microstructure, due to the limitation of a draft angle, in a case that an angle between the inner surface and the first end surface of the reflector is larger, the demoulding cannot be achieved, that is the processing and manufacturing of the reflector cannot be achieved. Specifically, upon the angle between the inner surface and the first end surface of the reflector being greater than 80 degrees, the processing and manufacturing of the reflector cannot be achieved.

However, the outer surface of the microstructure 2 in the reflector 1 of the light source module 100 provided by the disclosure includes the first surface 21 and the second surface 22. The microstructure 2 is located on the same side of the vertical plane 5 that intersects the starting edge 211 and is perpendicular to the first end surface 11, thus, the design of the first surface 21 provides a condition for demoulding, so that upon the angle between the inner surface of the reflector 1 and the first end surface 11 of the reflector 1 being greater than or equal to 80 degrees, the processing and manufacturing of the reflector 1 can also be achieved.

It should be noted that, the first surface 21 can be perpendicular to the first end surface 11, that is the angle a between the first surface 21 and the vertical plane 5 is 0°, referring to FIG. 7; or the angle a between the first surface 21 and the vertical plane 5 is the acute angle in a range of 0°-10°, referring to FIG. 8.

Furthermore, referring to FIG. 5, outer edges of the second end surface 12 extend outward to form a mounting ring 13.

The reflector 1 is usually formed by a mold. Upon processing and manufacturing the reflector, an appropriate molding method should be selected according to a material of the reflector 1. Common molding methods for the reflector 1 include: injection molding, stamping molding and the like. The reflector 1 manufactured by injection molding requires a metal reflective layer applying on the inner surface thereof, so that the reflector 1 can have a function of making the light uniform and adjusting the beam angle.

In summary, because the microstructure in the reflector is located on the same side of the vertical plane that intersects the starting edge and is perpendicular to the first end surface, upon the angle between the bus of the reflector and the first end surface being larger, the first surface of the microstructures is designed to facilitate demoulding in processing and manufacturing the reflector, the achievability of processing and manufacturing the reflector is ensured. At the same time, the second surface can play a role in making the light uniform and adjusting the beam angle.

In one or more embodiments, the plurality of microstructures are continuously arranged on the inner surface of the reflector.

In one or more embodiments, the second surface includes a starting edge and an ending edge, the ending edge of the first surface is connected with the starting edge of the second surface, and the ending edge of the second surface is connected with the starting edge of the first surface or the second end surface.

In one or more embodiments, the ending edge of the first surface is smoothly connected with the second surface. A ratio of a length of the first surface to a length of the second surface in a vertical direction may be an arbitrary value. Further, the curved surface may be an arc surface.

In one or more embodiments, the first surface coincides with the vertical plane. An angle between the first surface and the vertical plane is an acute angle. The angle between the first surface and the vertical plane is between 0 and 10 degrees.

In one or more embodiments, the first end surface is provided with a first opening, the first opening is a light incidence opening, the second end surface is provided with a second opening, the second opening is a light exit opening; a size of the first opening is less than a size of the second opening.

In one or more embodiments, the first surface is an arc surface. Here, outer edges of the second end surface extend outward to form a mounting ring. Further, the reflector is a secondary reflector, the light source module further includes a primary reflector, and the primary reflector is located between the light source and the secondary reflector.

As described above, the reflector and the light source module in the present disclosure have the following beneficial effects.

Because each of the microstructures in the reflector are located on the same side of the vertical plane that intersects the starting edge and is perpendicular to the first end surface, upon an angle between a bus of the reflector and the first end surface being larger, the first surface is designed to facilitate demoulding, and the achievability of processing and manufacturing the reflector is ensured. At the same time, the second surface can play a role in making the light uniform and adjusting the beam angle.

The specific embodiments described above further explain the objects, technical solutions and beneficial effects of the disclosure. It should be noted that, the foregoing is only the embodiments of the disclosure and not intended to limit the scope of protection of the disclosure, any modification, equivalent replacement or improvement within the spirit and the principle of the disclosure shall fall into the protection scope of the disclosure.

What is claimed is:

1. A reflector, comprising:

a first end surface and a second end surface opposite to each other, an inner surface of the reflector having a plurality of microstructures, wherein an outer surface of at least one of the plurality of microstructures comprises a first surface and a second surface, wherein the second surface is a curved surface, the first surface has a starting edge and an ending edge opposite to each other, and the curved second surface has a second starting edge and a second ending edge opposite to each other, the ending edge of the first surface is connected with the second starting edge of the curved second surface and the second ending edge of the curved second surface is connected with the starting edge of the first surface, and at least one of the plurality of microstructures is located on a same side of a vertical plane that intersects the starting edge and is perpendicular to the first end surface.

2. The reflector according to claim 1, wherein the plurality of microstructures are continuously arranged on the inner surface of the reflector.

3. The reflector according to claim 1, wherein the second surface comprises a second starting edge and a second ending edge, the ending edge of the first surface is connected with the second starting edge of the second surface, and the second ending edge of the second surface is connected with the starting edge of the first surface or the second end surface.

4. The reflector according to claim 1, wherein the ending edge of the first surface is smoothly connected with the second surface.

5. The reflector according to claim 1, wherein a ratio of a length of the first surface to a length of the second surface in a vertical direction is an arbitrary value.

6. The reflector according to claim 1, wherein the curved surface is an arc surface.

7. The reflector according to claim 1, wherein the first surface coincides with the vertical plane.

8. The reflector according to claim 1, wherein an angle between the first surface and the vertical plane is an acute angle.

9. The reflector according to claim 8, wherein the angle between the first surface and the vertical plane is between 0 and 10 degrees.

10. The reflector according to claim 1, wherein the first end surface is provided with a first opening, the first opening is a light incidence opening, the second end surface is provided with a second opening, the second opening is a light exit opening; a size of the first opening is smaller than a size of the second opening.

11. The reflector according to claim 10, wherein the first surface is an arc surface.

12. The reflector according to claim 11, wherein outer edges of the second end surface extend outward to form a mounting ring.

13. Alight source module, comprising a light source, wherein the light source module further comprises a reflector comprising:

a first end surface and a second end surface opposite to each other, an inner surface of the reflector having a plurality of microstructures, wherein an outer surface of at least one of the plurality of microstructures comprises a first surface and a second surface, wherein the second surface is a curved surface, the first surface has a starting edge and an ending edge opposite to each other, and the curved second surface has a second starting edge and a second ending edge opposite to each other, the ending edge of the first surface is connected with the second starting edge of the curved second surface and the second ending edge of the curved second surface is connected with the starting edge of the first surface, and at least one of the plurality of microstructures is located on a same side of a vertical plane that intersects the starting edge and is perpendicular to the first end surface, and wherein the light source is close to the first end surface of the reflector, and a size of the first end surface is greater than a size of the light source.

14. The light source module according to claim 13, wherein the reflector is a secondary reflector, the light source module further comprises a primary reflector, and the primary reflector is located between the light source and the secondary reflector.

15. The light source module according to claim 13, wherein the plurality of microstructures are continuously arranged on the inner surface of the reflector.

16. The light source module according to claim 13, wherein the second surface comprises a second starting edge and a second ending edge, the ending edge of the first surface is connected with the second starting edge of the second surface, and the second ending edge of the second surface is connected with the starting edge of the first surface or the second end surface.

17. The light source module according to claim 13, wherein the ending edge of the first surface is smoothly connected with the second surface.

18. The light source module according to claim 13, wherein a ratio of a length of the first surface to a length of the second surface in a vertical direction is an arbitrary value.

19. The light source module according to claim 13, wherein the curved surface is an arc surface.

20. The light source module according to claim 13, wherein the first surface coincides with the vertical plane.

* * * * *